United States Patent [19]

Davies

[11] Patent Number: 4,792,142

[45] Date of Patent: Dec. 20, 1988

[54] THERMAL TARGET DEVICE

[76] Inventor: Robert M. Davies, 1855 Waltham Rd., Columbus, Ohio 43221

[21] Appl. No.: 120,111

[22] Filed: Nov. 13, 1987

[51] Int. Cl.[4] ..... F41J 1/00

[52] U.S. Cl. ..... 273/348.1

[58] Field of Search ..... 273/348.1

[56] References Cited

U.S. PATENT DOCUMENTS

| | | | |
|---|---|---|---|
| 4,346,901 | 8/1982 | Booth | 273/348.1 |
| 4,405,132 | 9/1983 | Thalmann | 273/348.1 |
| 4,546,983 | 10/1985 | Rosa | 273/348.1 |

*Primary Examiner*—Edward K. Look

*Attorney, Agent, or Firm*—Francis T. Kremblas, Jr.

[57] ABSTRACT

An improved thermal target is disclosed which is characterized by its increased ability to take multiple hits with a dramatic reduction of the likelihood of failure due to short circuiting the electrical feed to the resistance heating elements. An improved heating element construction is provided by a pair of spaced, parallel disposed planar electrical busses having a resistance core element disposed in conducting relationship to the planar busses. The core can be designed to provide predetermined thermalized areas simulating a given thermal image, which areas are in constant electrical engagement with the planar buss so that a hit by a projectile will not likely interrupt the electrical current fed to the remaining thermalized area.

8 Claims, 2 Drawing Sheets

THERMAL TARGET DEVICE

BACKGROUND

Most modern weapon systems such as tanks and attack helicopters have thermal sights. Through its ability to sense infrared energy emissions, this sight allows the gunner to acquire, identify, and engage targets in darkness, smoke, fog and rain. Each potential target (vehicle) has a distinct infrared signature relative to heat emitting areas of the body and mode of operation, i.e. running or at idle. This sophisticated equipment has produced a need for a thermalized target which simulates the thermal signature as well as a visual silhouette. In other words the days of the simple "X" painted on a piece of plywood are over.

One of the early thermal targets proposed for military use is represented by U.S. Pat. No. 4,253,670.

However, most successful target systems employed today use electric heating elements referred to as thermal blankets. Typically, these units consist of a conductive coating on a sheet of plastic or paper with two thin copper buss bars attached parallel to each other along the edges of the coated area. The electrical resistance of the coating between the buss bars create heat as a current potential is induced across it.

The heating elements are placed is an array on a plywood silhouette, usually the front or flank view, to simulate a thermal image or signature. Wires are attached to the buss bars and run along the edge of the target to an electric power source at the bottom. Typically, the target is mounted on a lifting mechanism behind an earth berm or bunker. It is raised as required during the training scenario for the gunners to engage.

The blanket system has many deficiencies which impose delays in training. The major shortcoming is the vulnerability of the wire leads and buss bars to open circuits caused by a projectile severing the same during a shooting exercise. The open circuit stops the flow of electricity to the resistance element which causes failure to provide the thermal image. To reactivate the target, it is necessary to stop the exercise and replace or repair broken buss bars and wiring. This is time consuming and costly, particularly considering the manpower and equipment involved.

To eliminate the susceptibility to open circuits as projectiles pass through the targets, the heating elements' buss bars and wiring must be made totally redundant. This can be accomplished to a limited degree with double power feeds, one from each end, to the heating elements. However, there is still a chance that the redundant buss bars could be severed given their location and vulnerability of their location relative to the thermal image. Even with redundant wiring, a buss bar could receive multiple hits along its length which would render the area between the breaks inoperative and require repair.

SUMMARY OF INVENTION

The present invention relates generally to thermal image targets and particularly such a target provided with an improved heating element construction which dramatically improves the ability of the target to absorb multiple hits without total failure of the thermalized image.

The improved construction in accordance with the present invention includes providing a pair of planar electrical buss plates spaced from one another in parellel relationship to provide a uniform gap between the buss plates. Portions of the gap are filled with a conductive material to form a resistance heating element isolated by an appropriate insulating material which defines non-thermalized areas of a given thermal configuration. All current may be fed to the buss plates by a single lead wire attached to each buss plate in an area remote from the thermalized target areas and preferably in a protected or less exposed area such as the lower end of the buss. The lower end of such silhouette targets are typically disposed below ground level or behind an earthen bunker which makes the electrical leads and their connection to the buss plates dramatically less vunerable to destruction by a projectile compared to prior art buss bar configurations.

In accordance with the present invention, a sandwich type construction may be employed wherein the parallel aligned buss plates and the conducting and insulating areas forming a core layer therebetween are of a flexible or rigid nature. The flexible configuration would comprise relatively thin metal foil conductive components with similarly thin layers of a flexible insulating material employed as necessary to create tee sandwich. The rigid configuration is achieved by using a thicker, rigid backing material or support upon which the conductive material comprising the buss plates is distributed such that the sandwich is relatively self-supporting. However, the general concept of a pair of parallel buss plates with a core of conductive resistance material disposed between the buss plates remains the same in either configuration.

The construction of thermal targets as described herein provides a significant advantage as related to the ability to suffer multiple hits without a malfunction due to loss of the current feeding the resistance components.

Further, the construction lends itself to relatively economic manufacture in relationship to the improved performance mentioned above and can be effectively employed in three-dimensional targets as well as two dimensional silhouettes. Additional advantages of the construction of the present invention include easy design of a given thermal image merely by orienting the resistance portion of the core layer as needed with insulating material filling in the remaining core area. Since the entire silhouette area is fed via the planar buss plates, the whole area is capable of being thermalized in an economical manner in any given pattern within the confines of the silhouette area. Other advantages will become self-evident in view of the following description of preferred embodiments of the present invention.

DETAILED DESCRIPTION OF PREFERRED EMBODIMENTS

Figure 1:
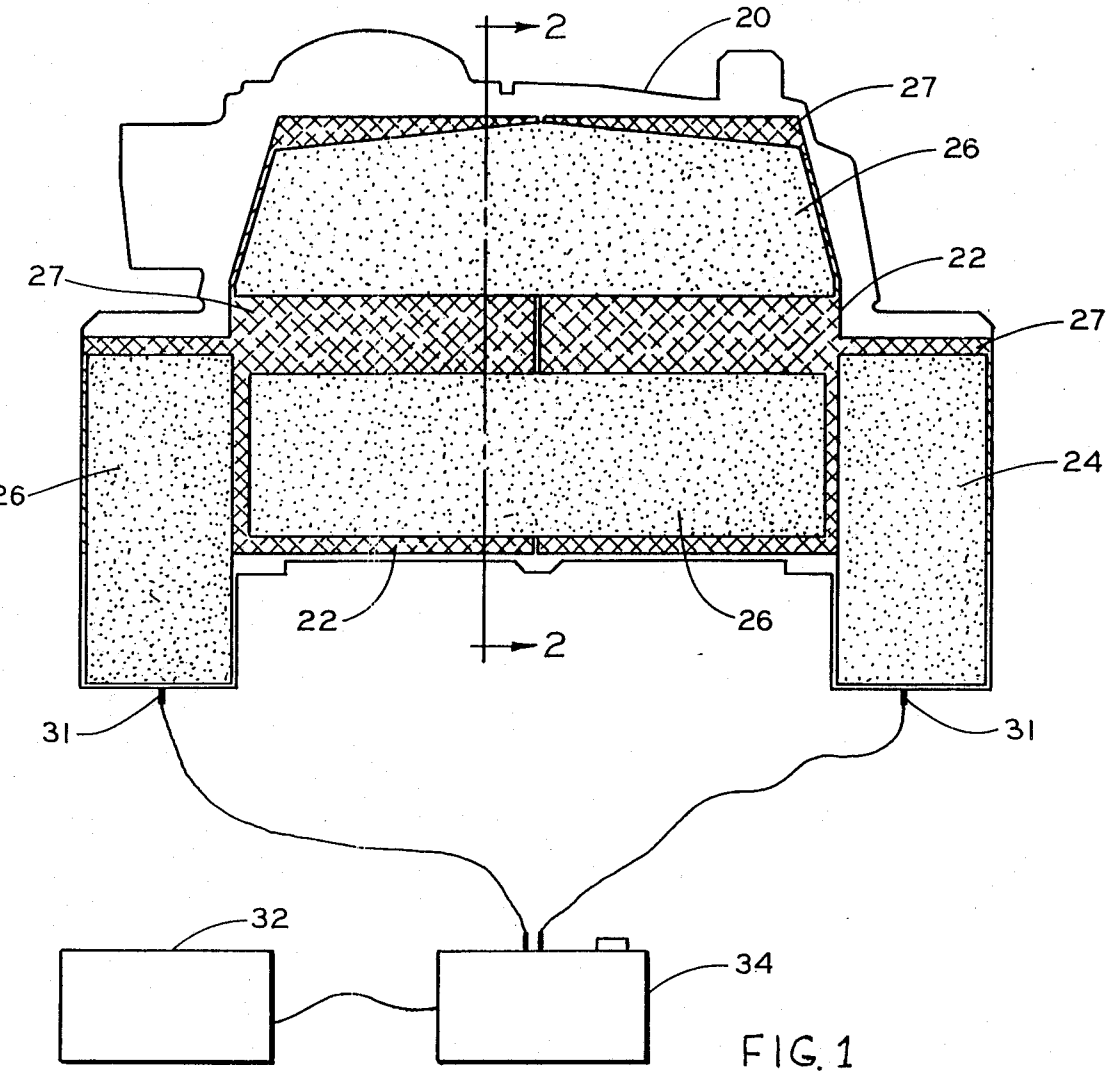
FIG. 1 is a front view, in section of a typical thermal target silhouette constructed in accordance with the present invention including a diagrammatic illustration of the electrical power supply and control means used in conjunction therewith.

A thermal target constructed in accordance with the present invention is shown in FIG. 1 and includes a two dimensional silhouette representing a military target. As seen in FIG. 1, a tank vehicle is represented for illustration purposes, however other target forms may be used within the spirit of the present invention.

Additionally, the structure providing additional support and/or for raising and lowering the target is not shown as such structure is conventional and well-known to those skilled in the art. Whether the thermal target is fixed in a vertical position or mounted for either horizontal or vertical movement is not directly relevant to the improvements and advantages of the present invention and therefore need not be described herein for understanding the operation of the present invention.

As seen in FIG. 1, a supporting frame or layer 20 is configured to simulate the visual frontal silhouette of a tank vehicle. Depending upon the desired nature of the thermal target construction, i.e. rigid or flexible, layer 20 may comprise any common insulating or non-conducting material such as a suitable plastic, plywood or even a metal sheet covered with an insulating material.

Adjacent to layer 20, a first buss plate 22 is disposed and fixed to layer 20. Buss plate 22 covers a planar area of slightly smaller dimensions than layer 20 but is provided with a generally similar, if less detailed outline of the target visual silhouette.

The buss plates may be formed in a variety of ways, however, the important feature is to provide a significant planar area of a conducting material extending in both vertical and horizontal directions over a surface area having approximately the outer confines of the desired thermal image.

In the sectional view shown in FIG. 1, a core layer, indicated generally at 24, is provided which consists of portions of a conducting material such as 26 separated by an insulating material which is not shown in FIG. 1, but would be disposed in areas such as indicated at 27. The areas of insulating material are not shown in FIG. 1 merely for better illustrating the buss plate 22.

Figure 2:
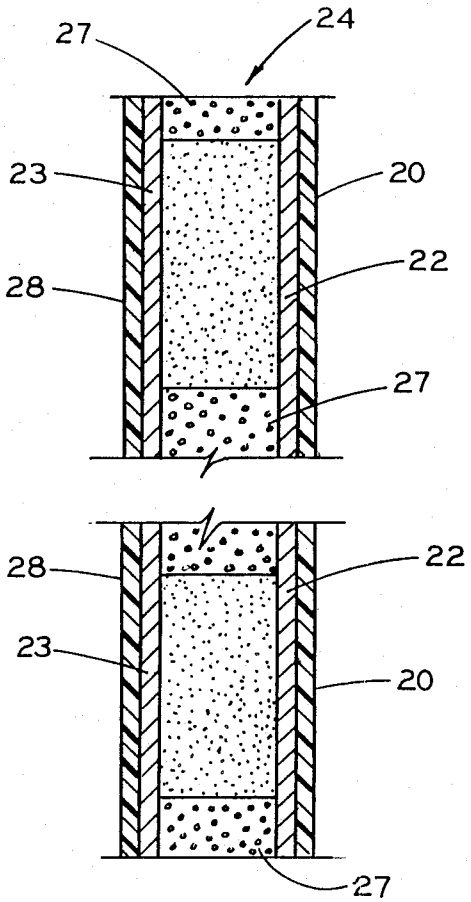
FIG. 2 is a partial side view in cross-section illustrating the components of a sandwich type construction of the thermal target such as shown in FIG. 1.

Conducting material 26 consists of a material having the necessary resistance characterics to form a suitable resistance heating element in connection with buss plate 22 and a second buss plate 23 as shown in FIG. 2, to provide the necessary thermal heat patterns visible with modern thermal sighting apparatus.

Referring to FIG. 2, a representative end cross-sectional view of a thermal target is shown. Outer insulated areas 20 and 28 form the outer layers of a sandwich type construction. First and second parallel, aligned buss plates 22 and 23 are fixed in any suitable conventional manner to the inner surface of a respective outer support layer 20 and 28 to provide a conducting surface distributed over essentially the entire inner surface of the layers 20 and 28 commensurate with the outer confines of a predetermined thermal image. Preferably, the outer edges of buss plates 22 and 23 terminate at least one quarter of an inch or more from the outer edges of layers 20 and 28 to prevent inadvertent electrical shock to personnel and to protect the conducting material comprising the buss plates from weather elements.

If deemed desirable for a given design, the outer edges of the conductive surface of the buss plates 22 and 23 could be covered with a vinyl or other suitable insulating material for additional safety and operational precautions.

As seen in FIG. 2, buss plates 22 and 23 may comprise various suitable conducting materials ranging from a thin metal foil or metallic film disposed over a suitable insulating backing sheet, a wire mesh or screen configuration secured to respective outer layers 20 and 28, or a metallic sheet having relatively small perforations. The key characteristics are that each buss plate is aligned in a relatively parallel relationship to one another providing a relatively uniform space for the conductive areas 26 of the core layer 24. Of course, it is necessary that the conductive areas 26 of core 24 remain in conducting relationship with co-extensive areas of each buss plates 22 and 23 to assure the electrical contact necessary to provide the heating function when power is supplied to the buss plates 22 and 23.

It should be noted that FIG. 2 is merely a diagrammatic representation of a sandwich type construction for the thermal target of tee present invention and is not illustrated in scale. The specific characteristics of the various insulating and conductive materials are well-known to those in the electrical resistance heating art and could be readily designed to meet the needs of a given thermal target application.

Figure 3:
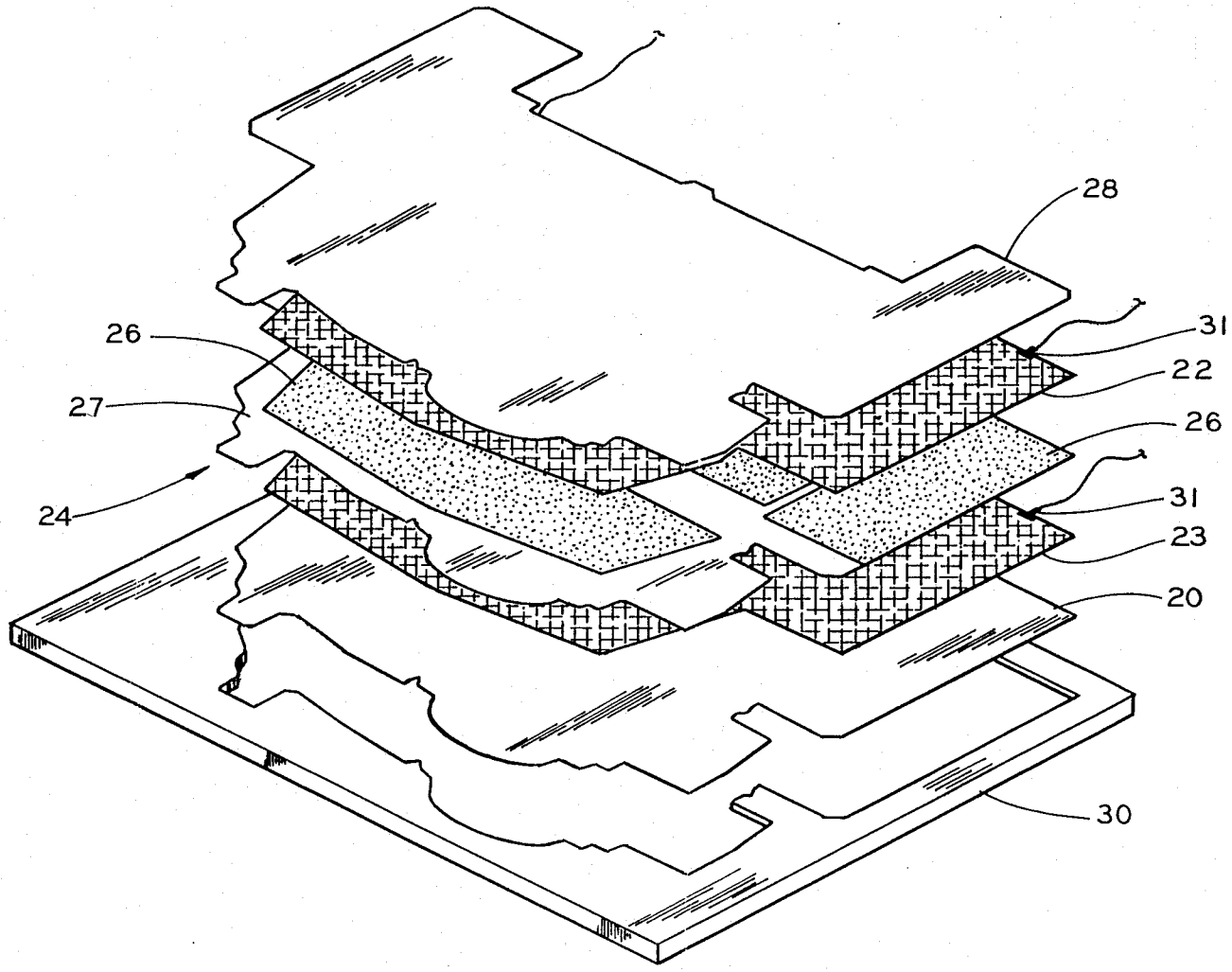
FIG. 3 is a perspective view illustrating the various layers comprising a sandwich construction of a thermal target incorporating the present invention.

Now referring to FIG. 3, a diagrammatic representation of a method of making a thermal target constructed in accordance with the present invention is illustrated wherein the target comprises a plurality of layers which may be molded or otherwise affixed to one another to form a sandwich construction.

Employing conventional resin molding techniques, such a sandwich construction would include providing a first outer layer 20 comprising an insulating fiberglass matt for example.

This outer layer 20 would be cut to the silhouette outline such as shown i FIG. 1 and placed on the bottom portion of a mold illustrated at 30. Next a sheet of light gauge wire mesh cut to the dimensions such as shown in FIG. 1 would be aligned over the outer layer 20 to form first buss plate 22. The outer edges of the wire mesh should be no closer than 0.25 inches from the perimeter of layer 20.

A core layer 24 prepared from a thin layer of insulating material 27 cut to provide complete area coverage of buss plate 22 and with openings having a configuration of the desired thermalized areas is prepared and laid over the wire mesh buss plate 22. The open areas are filled with a suitable conductive layer 26 having the same thickness as insulating material 27 and positioned within the openings therein in contact with buss plate 22.

Conventional and well-known sheet products comprising thermal setting resins having imbedded graphite fibers are readily commercially available and may be used for resistance components forming conducting material 26. Similar products without the graphite fibers may be used for the insulating portions 27 of core 24. Such materials are sometimes referred to as fiberglass matts. The particular electrical resistance characteristics of the conducting sheet 26 is a matter of conventional design depending upon the requirements of the application.

Next a sheet of wire mesh conducting material the same as buss plate 22 is placed over the core layer 24 to form a buss plate 23 and is similarly aligned in conducting relationship to the conducting material 26.

The lower end of each buss plate 22 and 23 is provided with a small contact plate, such as 31, which comprises thin metallic pieces which are conventionally riveted to the wire mesh screen to extend outwardly forming conductor terminals.

Another outer layer 28 of the same type and dimension as layer 20 is laid over buss plate 23. Then a conventional proportional and catalyzed thermal setting resin is poured uniformly over the sandwich layers and the top half, not shown, of the mold is placed over the assembly. Conventional resin molding techniques may be employed, however, approximately a pressure of 30 PSI evenly applied to the mold during the time required for cure of the resin is suggested.

After the resin has cured, the assembled sandwich can be removed and any excess resin trimmed from the edges.

An appropriate hole may be drilled in each conductor terminal 31 so that a wire lead may be secured thereto in any conventional manner. For example, a crimped lug and set screw assembly may be used to afix a wire lead to each terminal 31.

Once completed and positioned at the site, an appropriate power supply, such as 32, and conventional regulating and control means, such as 34, illustrated in FIG. 1 may be operatively connected to the wire leads to supply electrical power to the thermal target unit.

Many conventional electrical circuits may be used to supply power and control the temperature of the resistance elements and can vary widely depending upon the materials employed and the application. Such conventional electrical circuitry is well-known and alone forms no portion of the present invention.

Other variations of construction and materials employed may be used without departing from the spirit of the present invention. However, the important concepts of providing a reliable thermal target consisting of parallel, spaced conducting busses providing an electrical feed over a broad area generally co-extensive with the outer limits of a given thermal image with a core resistance element disposed therebetween to form predetermined thermalized areas simulating a thermal target, remains the same.

In accordance with the present invention, an artillery projectile, typically without the explosive charge in target practice exercises, will pass through the target and remove only a portion of the planar busses and core 24 commensurate with the size of the warhead. However, the remaining portions of the buss plates and conducting resistance portion 26 remain operational as current is still provided through those portions remaining intact.

In view of the foregoing description, it should be readily understood that the present invention provides an improved thermal image target which possesses greater resistance to break downs due to projectile damage, hence greater reliability to withstand multiple hits compared to those of the prior art.

Further, the construction of such a thermal target may range from relatively simple plywood outer frames provided with a conductive material distributed over their inner surfaces and a suitable core resistance element to a molded unitary sandwich design such as described herein.

What is claimed is:

1. A simulated military target comprising, in combination, a supporting frame having a predetermined shape simulating at least one planar silhouette of a likeness of a military target; a heating element mounted on said supporting frame in a predetermined planar configuration providing a thermal image simulating a predetermined thermal image of said military target; said heating element comprising a pair of planar electrical conducting busses disposed in spaced parallel relationship to one another, the planar surface of each of said busses facing the other provided with an electrical conducting material distributed over said planar surface to provide a source of current over a surface area generally similar in configuration to said supporting frame, and means forming a resistance element disposed in electrically conducting relationship between opposing portions of said conducting surfaces of said busses to form a predetermined thermal image representing the thermal image of a military target; and electrical leads operatively connected to each of said busses at a location remote from the area having said resistance element and to a supply of electrical power for providing electrical current to the conductive material distributed over the surface of said busses.

2. The thermal target defined in claim 1 wherein said electrical conducting material distributed over said planar surface comprising a continuous metallic layer.

3. The thermal target defined in claim 2 wherein said metallic layer comprises a planar sheet having a wire mesh configuration.

4. The thermal target defined in claim 2 wherein said metallic layer comprises a sheet having a plurality of openings substantially smaller than the projectile intended to strike the target for purposes of a predetermined training exercise.

5. The thermal target defined in claim 1 wherein said heating element comprises a plurality of layers connected to one another forming a unitary planar sandwich configuration including a pair of outer layers of insulating material spaced from one another in parallel relationship, a layer of conducting material attached to and distributed over the inner facing surfaces of each of said outer layers in uniformly spaced relationship to the opposing surface forming parallel busses and an inner core layer disposed between said conducting material on said inner facing surfaces, said core layer including a conductive material disposed in a predetermined planar pattern in conducting relationship to said busses and forming a resistance heating component, and an insulating material disposed in the remainder of said core in surrounding relationship to resistance heating component.

6. A heating element for thermal a target for simulating a predetermined thermal image comprising in combination, a planar sandwich configuration including a first planar layer of insulating material having an inner and outer surface; second layer of electrical conducting material distributed over the inner surface of said first layer to form a planar buss; a third layer forming a core and including at least one planar area of electrical conducting material surrounded by insulating material; a fourth planar layer of insulating material having inner and outer surfaces; a fifth layer of electrical conducting material distributed over the inner surface of said fourth layer in substantially parallel relationship to said second layer and wherein said electrical conducting material of said core is disposed in electrical conducting relationship to said material forming said second and fifth layers to form a resistance heating component upon the communication of electrical current to said second and fifth layers and wherein said layers are bound together to form a unitary construction.

7. The heating element defined in claim 6 wherein said second and fifth layers comprise a metallic sheet.

8. The heating element defined in claim 6 wherein said second and fifth layers comprise a metallic sheet having a wire mesh configuration.

* * * * *